US011661773B2

(12) United States Patent
Cano

(10) Patent No.: US 11,661,773 B2
(45) Date of Patent: May 30, 2023

(54) DOUBLE BOTTOM SLIDER SYSTEM AND MECHANISM

(71) Applicant: American Glasscrafters, Inc., Carlstadt, NJ (US)

(72) Inventor: Joseph Cano, Ridgewood, NJ (US)

(73) Assignee: American Glasscrafters, Inc., West Caldwell, NJ (US)

( * ) Notice: Subject to any disclaimer, the term of this patent is extended or adjusted under 35 U.S.C. 154(b) by 992 days.

(21) Appl. No.: 16/398,941

(22) Filed: Apr. 30, 2019

(65) Prior Publication Data

US 2019/0330889 A1 Oct. 31, 2019

Related U.S. Application Data

(60) Provisional application No. 62/664,325, filed on Apr. 30, 2018.

(51) Int. Cl.
*E05C 7/00* (2006.01)
*E05B 65/08* (2006.01)

(52) U.S. Cl.
CPC ..... *E05C 7/00* (2013.01); *E05B 65/0829* (2013.01); *E05C 2007/007* (2013.01); *E05Y 2900/114* (2013.01); *Y10S 292/46* (2013.01); *Y10T 292/1079* (2015.04); *Y10T 292/308* (2015.04)

(58) Field of Classification Search
CPC ..... Y10S 292/21; Y10S 292/46; E05C 7/00; E05C 7/02; E05C 2007/007; E05B 65/0829; E05B 65/08; E05B 83/40; E06B 3/4681; Y10T 292/03; Y10T 292/0856; Y10T 292/1079; Y10T 292/308
USPC ..... 49/413, 449, 451
See application file for complete search history.

(56) References Cited

U.S. PATENT DOCUMENTS 369,146 A * 8/1887 Woll ..... E05B 83/24 292/199
416,583 A * 12/1889 Dickson ..... B66B 13/06 187/326
608,461 A * 8/1898 Leach ..... E05B 65/0858 292/51

(Continued)

FOREIGN PATENT DOCUMENTS

DE 1021751 B * 12/1957
EP 0978612 A2 * 2/2000

(Continued)

*Primary Examiner* — Carlos Lugo
(74) *Attorney, Agent, or Firm* — Richard Malagiere, Esq.

(57) ABSTRACT

A shower door assembly with translating glass door panels riding in a lower track and supported by an upper center guide with a locking mechanism providing that one glass door is locked in place while the other glass door is allowed to translate. A double bottom slider system and mechanism for a sliding door assembly allow the doors to translate relative to each other. A locking system located on the top portion of the lower track made up of an inner door gear element attached to a torque loading device with a protruding element in contact with the inner door panel meshed with an outer door gear element with a protruding element in contact with the outer door panel. The shower door assembly operates in the setting of sliding all glass shower door systems to lock one door in place while the other door is free to translate.

6 Claims, 7 Drawing Sheets

(56) References Cited

U.S. PATENT DOCUMENTS 626,503 A * 6/1899 Oakley ..... E05B 65/0858 292/51
1,646,181 A * 10/1927 Babekuhl ..... E05B 83/02 70/95
2,574,736 A * 11/1951 Gerow ..... E06B 3/984 49/413
2,883,227 A * 4/1959 Hoofe, III ..... E05B 65/0864 292/DIG. 46
2,949,647 A * 8/1960 Migneault ..... H01J 31/20 49/440
3,083,045 A * 3/1963 Linderoth ..... E05B 65/0847 49/413
3,151,901 A * 10/1964 Aldgren ..... E05D 13/04 292/124
4,054,308 A * 10/1977 Prohaska ..... E05B 65/0829 49/449
4,385,551 A * 5/1983 Zboralski ..... B08B 15/023 292/216
4,489,965 A * 12/1984 Taylor ..... E05B 65/0864 292/147
4,635,976 A * 1/1987 Sigler ..... E05B 65/0847 70/95
4,829,887 A * 5/1989 Holschbach ..... E05B 65/0003 292/216
4,872,287 A * 10/1989 Block ..... E05B 65/0823 16/87 R
4,932,694 A * 6/1990 Cater, Sr. ..... E05B 65/0841 292/210
5,108,162 A * 4/1992 Lund ..... E05B 65/0003 292/213
6,616,214 B2 * 9/2003 Wattebled ..... E05B 83/38 292/26
7,861,976 B2 * 1/2011 Holemans ..... B64G 1/641 244/119
9,340,215 B2 * 5/2016 Masuda ..... E05B 65/0847
9,556,652 B2 * 1/2017 Lund ..... E05C 3/14
2004/0016080 A1 * 1/2004 De Oliveira ..... E05D 15/063 16/97
2013/0199099 A1 * 8/2013 Ryden ..... E05F 5/003 49/449

FOREIGN PATENT DOCUMENTS

FR 1603409 A * 4/1971
FR 2770575 A1 * 5/1999 ..... B60J 10/40
KR 730642 B1 * 6/2007 ..... E05B 65/08

* cited by examiner

A-A

A-A
LOWER PORTION BLOW UP

B-B
INNER DOOR LOCKED

B-B
INNER DOOR LOCKED

B-B
OUTER DOOR LOCKED

DOUBLE BOTTOM SLIDER SYSTEM AND MECHANISM

PRIORITY

This application claims priority to provisional application 62/664,325 filed on Apr. 30, 2018.

BACKGROUND OF INVENTION

The present invention is directed to a double bottom slider mechanism located at the bottom portion of a shower door system—specifically for a glass shower door enclosure system. An all glass shower door slider system is presented with a roller track on the bottom and a guide at the top in the center of the two glass doors that translate relative to one another. The concern is that the show doors are never together aligned one in front of the other on one side of the track. This is a concern because the weight of both doors being on one side of the track at the same time could cause the doors to become unstable and tilt or fall over out of the roller track. This concern is addressed by the present mechanism which allows for the inner door to be locked in position when the outer door is free to move and conversely, the outer door to be locked in position when the inner door is free to move.

BRIEF SUMMARY OF INVENTION

The object of the present invention is to disclose a mechanism which operates in the setting of sliding all glass shower door systems to lock one door in place while the other door is free to translate. Specifically, each glass panel has two sets of rollers attached at the bottom of the panel. These rollers ride inside a sliding track located at the bottom of the shower door system. The top of the glass panels rides in a bridge bracket without the aid of rollers. A set of two gears (an inner gear and an outer gear) is located at the center of the opening within which the two glass doors operate above the rollers. These gears are in contact with the edges of each glass panel. The set of two gears are set to work in opposite directions.

Specifically, when the inner gear turns counter clockwise, the outer gear turns clockwise. Also, the inner gear is connected to a torque spring. When the inner gear is turned counter clockwise, the tension in the torque spring pushes it back to its original position. So, when the inner glass door is in the closed position and locked by the inner gear of the locking mechanism, the outer gear is in the open position and as such, the outer glass door is free to move from side to side because it is supported by the inner glass door locked in its position. Conversely, when the outer glass door is in the closed position and locked by the outer gear of the locking mechanism, the inner gear is in the open position and as such, the inner glass door is free to move from side to side because it is supported by the outer glass door.

DRAWINGS

DETAILED DESCRIPTION OF INVENTION

Figure 1:
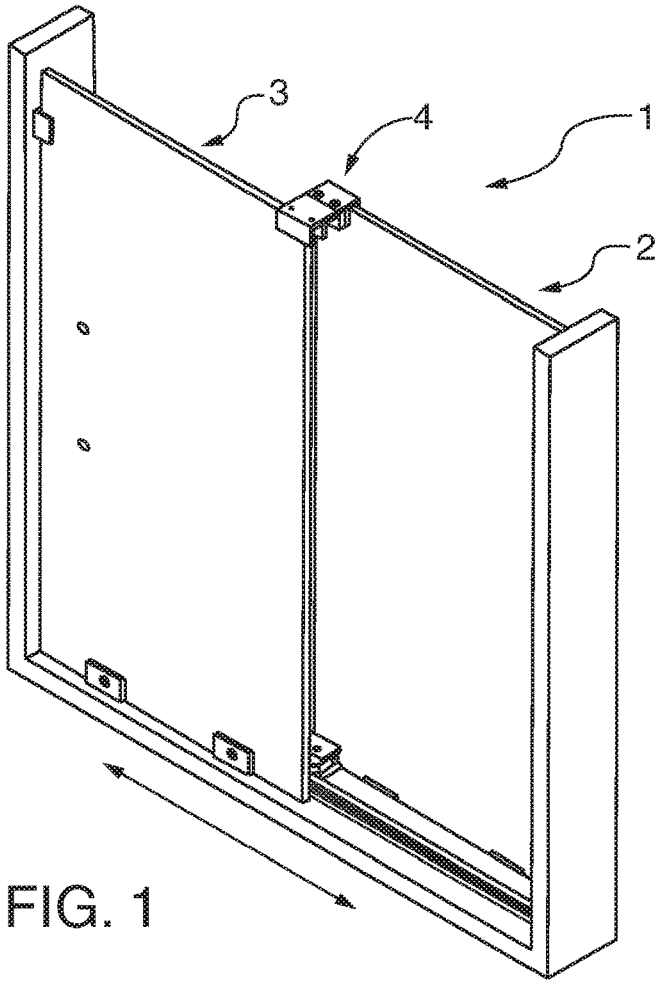
FIG. 1 is an isometric view of the shower door system of the present invention.

The present invention will now be described in terms of the presently preferred embodiment thereof as illustrated in the drawings. Those of ordinary skill in the art will recognize that may obvious modifications may be made thereto without departing from the spirit or scope of the present invention.

Figure 2:
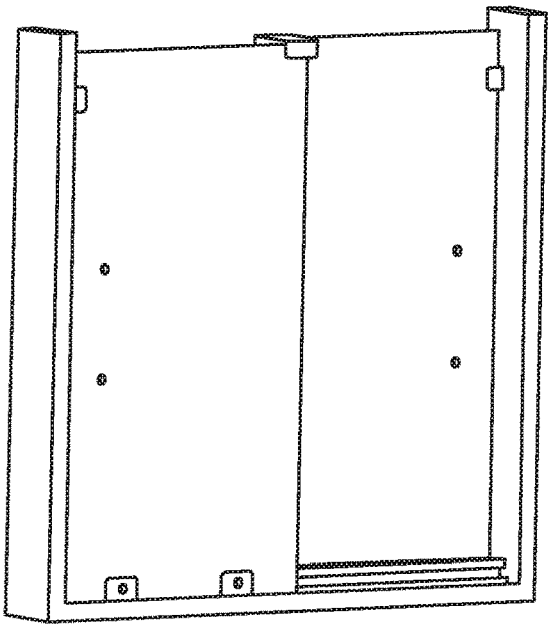
FIG. 2 is an isometric view of the shower door system of the present invention.
Figure 3:
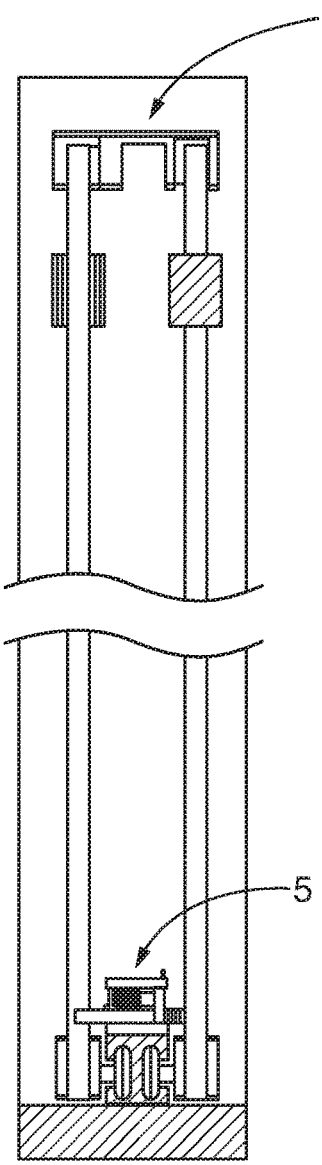
FIG. 3 is a side view cutaway of the shower door system of the present invention.
Figure 4:
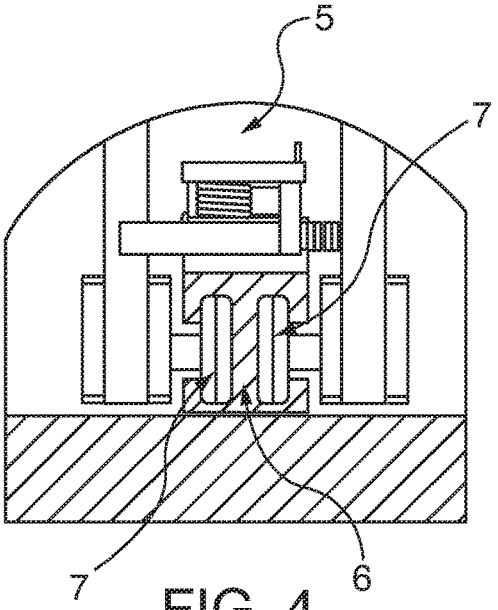
FIG. 4 is a close-up cross-section view of the lower track of the shower door system of the present invention.
Figure 5:
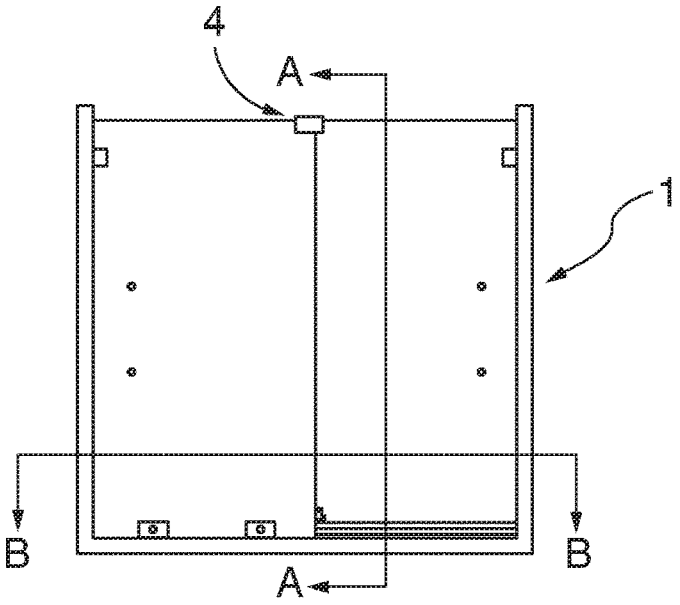
FIG. 5 is a side view of the bottom roller assembly stop

The present invention discloses an all glass shower door system [1] with a front glass panel [3] and a rear glass panel [2]. FIG. 1 and FIG. 2. Both the front glass panel [3] and the rear glass panel [2] ride on rollers [7] in a lower track [6] to allow the doors [2] and [3] to translate relative to each other. FIG. 1, FIG. 3 and FIG. 4. The top of the shower door system [1] has an upper guide [4] in which the doors [2] and [3] ride to support the top portion of the all glass shower doors. FIG. 1 and FIG. 2.

Figure 6:
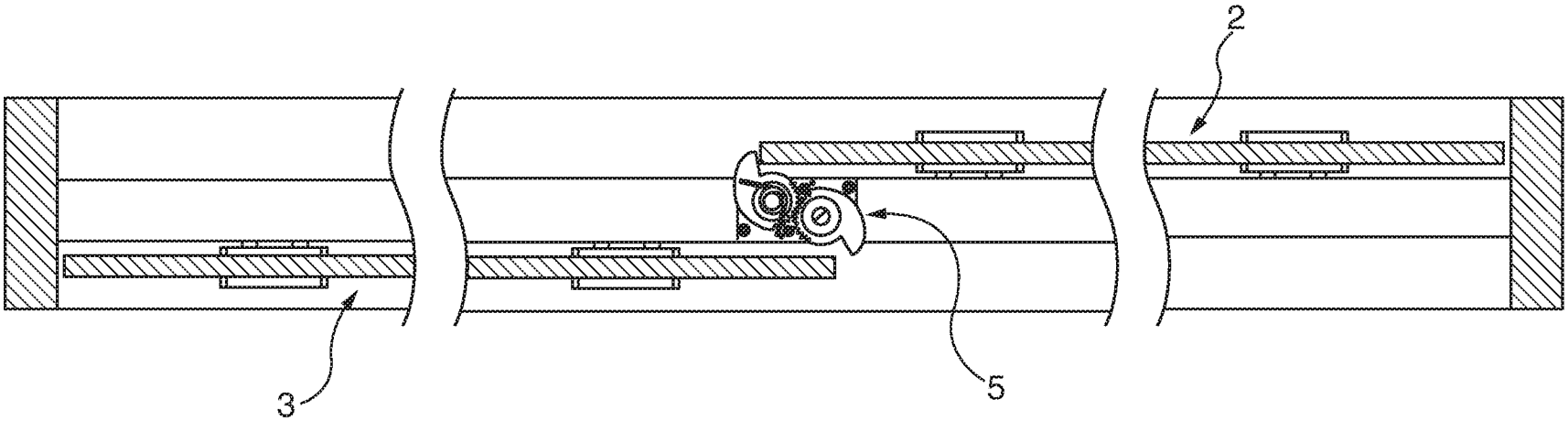
FIG. 6 is a cross section along line B-B from FIG. 5 of the lower track of the shower door system of the present invention.
Figure 7:
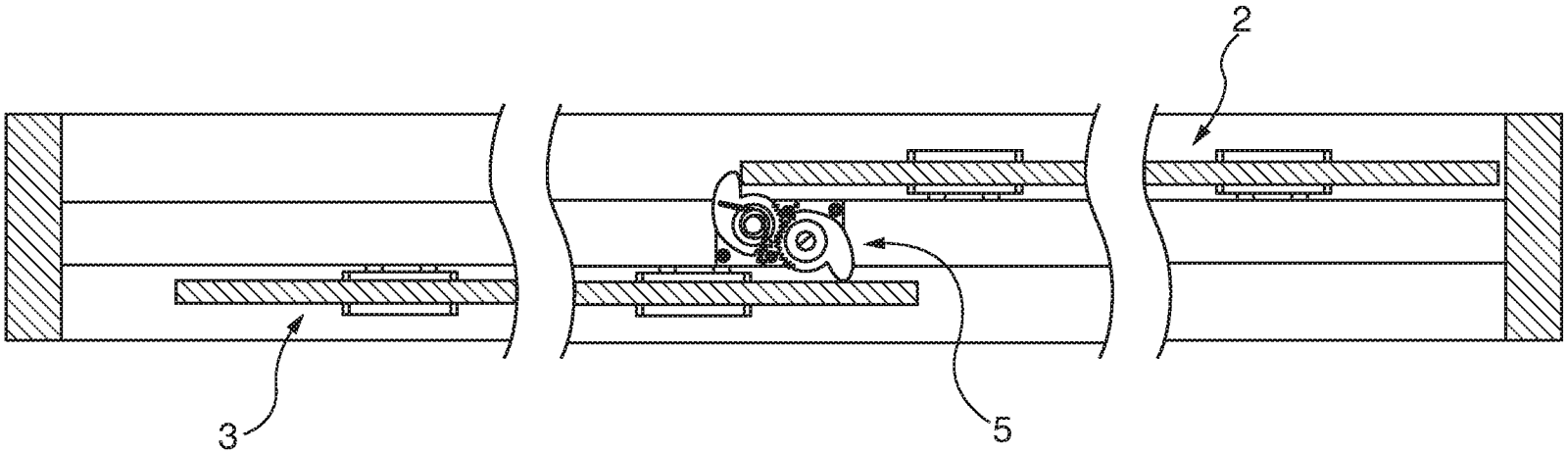
FIG. 7 is a cross section along line B-B from FIG. 5 of the lower track of the shower door system of the present invention.
Figure 8:
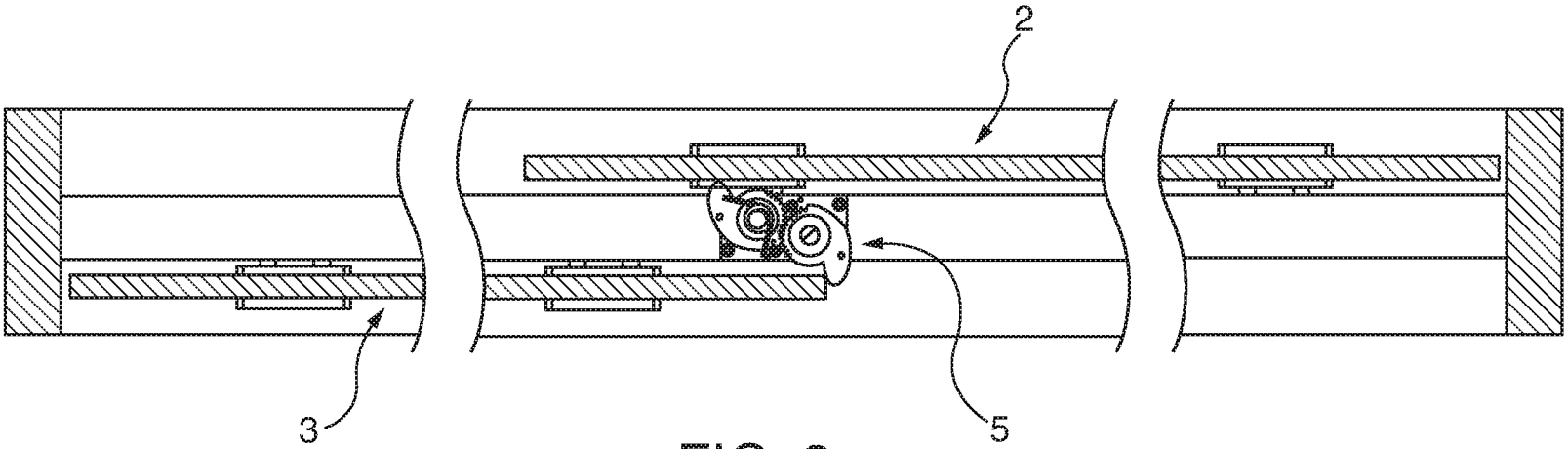
FIG. 8 is a cross section along line B-B from FIG. 5 of the lower track of the shower door system of the present invention.
Figure 10:
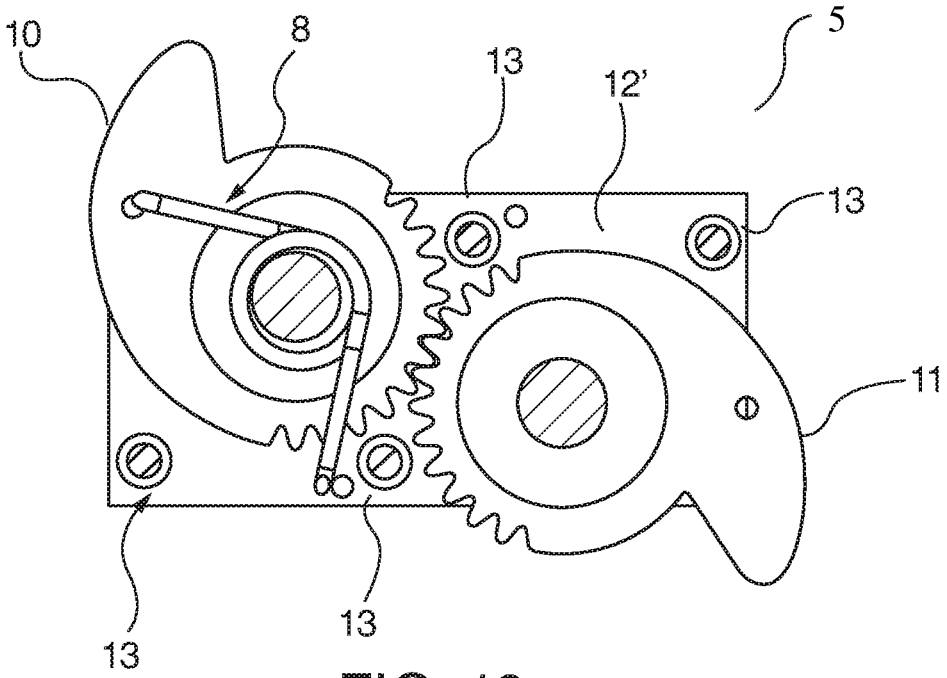
FIG. 10 is a top view of the operative mechanism of the shower door system of the present invention.

When both the front glass panel [3] and the rear glass panel [2] are on one side of the shower door system [1] there is a concern that the upper guide will not provide the support for the doors to remain in the lower track [6] safely and the weight of both doors [2] and [3] together will cause the front glass panel [3] and the rear glass panel [2] to want to tilt out. In an effort to address this, the present invention discloses a locking mechanism with two gears [5] (an inner gear [10] and an outer gear [11]) located at the center of the opening within which the two glass doors [2] and [3] operate above the rollers [7]. FIG. 10. These gears [10] and [11] are in contact with the edges of each glass panel [2] and [3]. FIGS. 6, 7 and 8.

Figure 9:
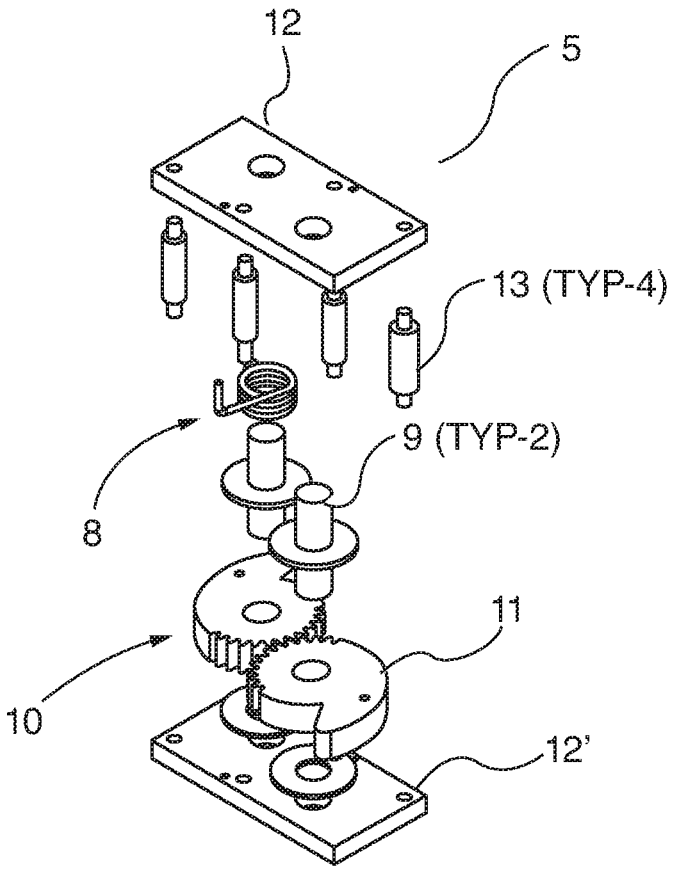
FIG. 9 is an assembly view of the operative mechanism of the shower door system of the present invention.

The locking mechanism [5] consists of an inner gear [10] attached to a spring [8] to create a clockwise torque on the inner gear [10]. The spring [8] is wrapped around the inner gear [10] shaft and bearing [9]. One end of the spring [8] is fixed to a top cover plate [6] and the other end is fixed into the inner gear [10]. The outer gear [11] is meshed (or paired) with the inner gear [10] so that the rotational direction of the paired gears is opposite to each other. FIG. 9 and FIG. 10. The entire locking mechanism is captured between top [12] and bottom [12'] cover plates by means of spacer elements [13] affixed on each corner of the cover plates [12] and [12']. FIG. 9. This locking mechanism assembly [5] is then placed on top of the lower track [6] where it can interface with the inner [10] and outer [11] glass doors. FIG. 3 and FIG. 4.

Both the inner gear [10] and the outer gear [11] have a protruding element which is designed to be shaped so that this element of each gear interferes with and is contact with the edge of the inner glass door [2] and outer glass door [3], respectively. FIG. 10, FIG. 7 and FIG. 8. So, when the inner glass door [2] is locked in one direction by the inner gear [10] locked into position with the spring [8], the outer glass door [3] is free to translate because the outer gear [11] is rotated out the way. FIG. 6 and FIG. 7. When the outer door [3] is locked in one direction by the outer gear [11] locked into position with the spring [8], the inner glass door [2] is free to translate because the inner gear [10] is rotated out of the way. FIG. 8.

The above-described system provides that while either one of the glass doors [2] or [3] are free to be in motion, the other glass door is locked in place. This, of course, prevents both glass doors [2] and [3] from being aligned together on one side or other of the lower track [6] and thereby creating an unstabbed alignment.

The locking system mechanism can be fabricated form a variety of materials and a variety of material combinations. The preferred embodiment of the present invention operates with plastic gears, shafts and bearing surfaces. Of course, these items can be made of aluminum or stainless steel to provide additional strength and wear resistance while providing corrosion resistance.

Those of ordinary skill in the art will recognize that the embodiments just described merely illustrate the principles of the present invention. Many obvious modifications may be made thereto without departing from the spirit or scope of the invention as set forth in the appended claims.

What is claimed is:

1. A double bottom slider system and mechanism for a sliding door assembly comprising an inner door panel and an outer door panel slidingly engaged between an upper guide and lower track to allow the doors to translate relative to each other;

a locking system located on the top portion of the lower track made up of an inner door gear element attached to a torque loading device, such that the inner door gear element is urged clockwise by the torque loading device, with a protruding element in contact with the inner door panel meshed with an outer door gear element with a protruding element in contact with the outer door panel;

the inner door gear element loaded in the clockwise direction with the torque device such that when the inner door panel is fully closed, the protruding element on the inner door gear element is locked against the edge of the inner door panel and the protruding element on the outer door gear element is disengaged from the edge of the outer door panel;

the outer door gear element rotated in the clockwise direction, such that the protruding element on the outer door gear is locked against the edge of the outer door panel and the protruding element on the inner door gear element is disengaged form the edge of the inner door panel;

wherein, to lock the inner door panel, the inner door panel is moved toward a closed position and the outer door panel is moved away from the closed position, therefore the inner door gear element loaded in the clockwise direction with the torque device such that when the inner door panel is fully closed, the protruding element on the inner door gear element is locked against the edge of the inner door panel and the protruding element on the outer door gear element is disengaged from the edge of the outer door panel; and wherein, to lock the outer door panel, the outer door panel is moved toward a closed position and the inner door panel is moved away from the closed position, therefore, the edge of the inner door panel contact the protruding element of the inner door gear, so that the outer door gear element is rotated the clockwise direction, the protruding element on the outer door gear is locked against the edge of the outer door panel and the protruding element on the inner door gear element is disengaged form the edge of the inner door panel.

2. The sliding door assembly of claim 1, wherein the inner door panel and outer door panel are glass shower doors.

3. The sliding door assembly of claim 2, wherein the inner door gear element and outer door gear element are plastic.

4. The sliding door assembly of claim 2, wherein the inner door gear element and outer door gear element are stainless steel.

5. The sliding door assembly of claim 2, wherein the inner door gear element and outer door gear element are aluminum.

6. The sliding door assembly of claim 2, wherein the torque loading device is a spring.

* * * * *